US006334390B1

(12) United States Patent
Schaede

(10) Patent No.: US 6,334,390 B1
(45) Date of Patent: Jan. 1, 2002

(54) DEVICE FOR THE TREATMENT OF A PAPER WEB

(75) Inventor: Johannes Georg Schaede, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/581,214

(22) PCT Filed: Dec. 22, 1998

(86) PCT No.: PCT/DE98/03754

§ 371 Date: Jun. 22, 2000

§ 102(e) Date: Jun. 22, 2000

(87) PCT Pub. No.: WO99/33663

PCT Pub. Date: Jul. 8, 1999

(30) Foreign Application Priority Data

Dec. 24, 1997 (DE) ..... 197 57 896

(51) Int. Cl.[7] ..... B41F 13/54

(52) U.S. Cl. ..... 101/228; 101/DIG. 42

(58) Field of Search ..... 101/228, DIG. 42, 101/219, 231, 232; 226/195; 100/168, 172, 176

(56) References Cited

U.S. PATENT DOCUMENTS

| | | | | |
|---|---|---|---|---|
| 2,147,421 A | | 2/1939 | Bendz | |
| 3,074,086 A | | 1/1963 | Remer | |
| 4,117,699 A | * | 10/1978 | Renaut | 101/470 |
| 4,211,165 A | * | 7/1980 | Schill | 100/168 |
| 4,485,734 A | * | 12/1984 | Klemmer et al. | 100/168 |
| 4,610,649 A | * | 9/1986 | Friess | 493/11 |
| 5,806,432 A | | 9/1998 | Kurth | |

FOREIGN PATENT DOCUMENTS

| | | |
|---|---|---|
| DE | PS 245182 | 8/1910 |
| DE | 21 61 322 | 4/1981 |
| DE | 37 40 044 | 6/1989 |
| DE | 196 17 601 | 5/1997 |

* cited by examiner

*Primary Examiner*—Ren Yan
(74) *Attorney, Agent, or Firm*—Jones, Tullar & Cooper, PC

(57) ABSTRACT

A pair of calender rollers are placed before, in a direction of travel of a paper web or paper sheets to a first print unit in a printing device. The calendering rollers improve the quality of the paper web or sheets by rolling particles adhering to the web or sheets into the web or sheets. A paper web tensioning device can be placed between the calendering rollers and the first print unit.

7 Claims, 1 Drawing Sheet

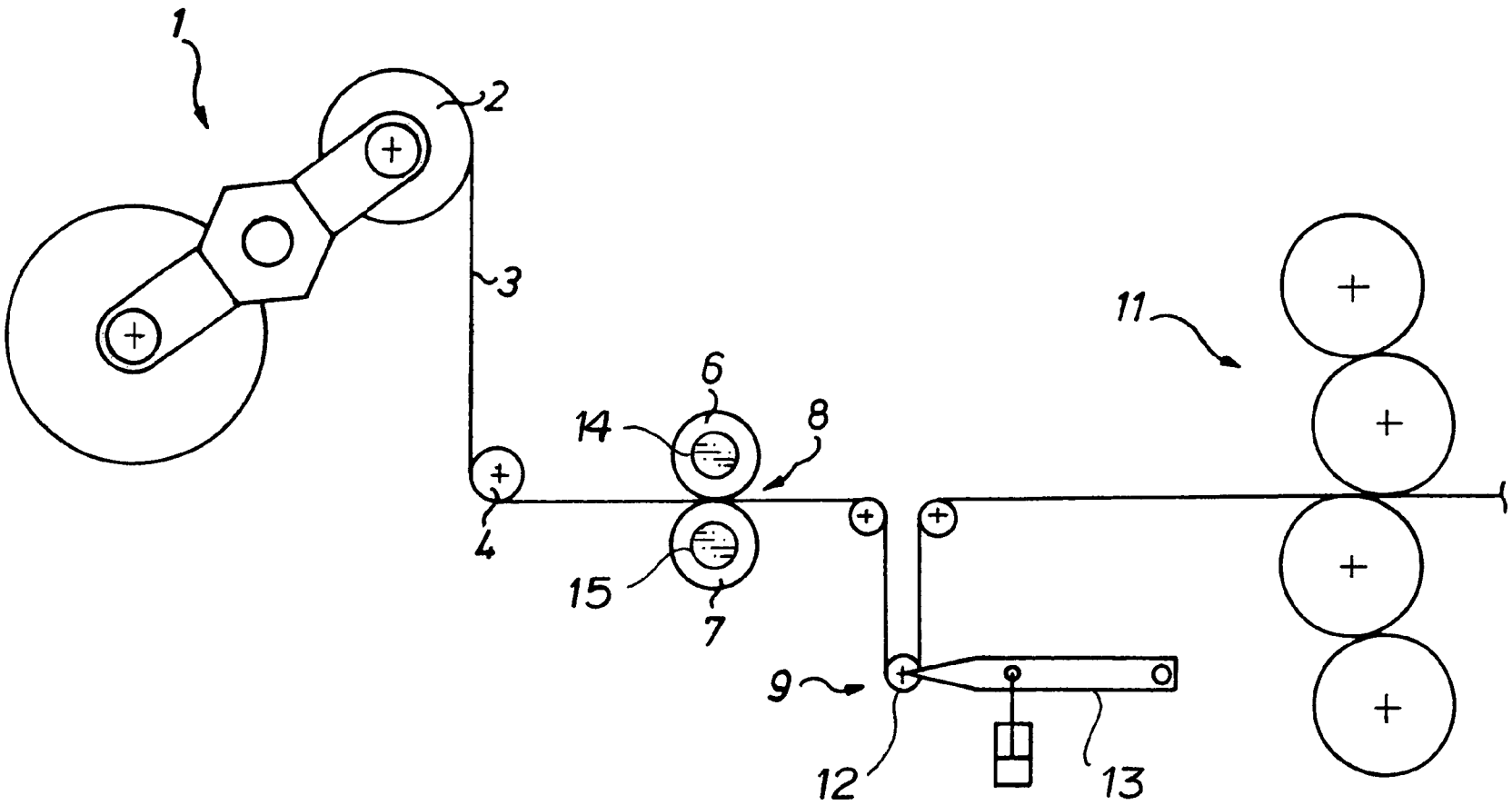
1
2
3
4
6
7
8
9
11
12
13
14
15

DEVICE FOR THE TREATMENT OF A PAPER WEB

FIELD OF THE INVENTION

The present invention relates to a device for treating a paper web or a sheet of paper prior to being printed. The paper is treated in a calender roller pair upstream of the first printing unit.

DESCRIPTION OF THE PRIOR ART

A device for treating a paper web prior to printing is known from DE 21 61 322 C3. In this device, the paper web is subjected to a pre-pressing process by means of a pair of drawing rollers in order to keep the paper web stable during printing.

The drawing rollers of this prior device have an at least small difference in circumferential speed in comparison with the cylinders of the successive print units. By means of this, it is intended to remove possible paper dust or particles which may be loosely attached to the paper web prior to the web entering the first print unit. A dampening agent unit can be placed against each drawing roller.

DE 196 17 601 A1 describes a method for printing and upgrading webs, wherein the running web is satinized and subsequently printed without intermediate winding.

DE-PS 245 182 shows a paper web, which is satinized between the lacquering and printing processes.

U.S. Pat. No. 2,147,421 discloses calender rollers, wherein one of the calender rollers is driven by means of an rpm-controlled electric motor.

SUMMARY OF THE INVENTION

The object of the present invention is based on providing a device for treating a paper web or a sheet of paper prior to printing.

In accordance with the present invention, this object is attained by providing a calender roll pair upstream of the first printing unit. At least one of the calender rollers of the pair is driven by its own relative position-regulated electric motor. A paper web tension regulating device may be arranged between the calender roller pair and a first printing unit. The first print unit may accomplish offset printing with "waterless" planographic printing formes.

The advantages which can be achieved by the present invention in particular rest in that it is not necessary to assign additional mechanical aids or dampening water to the pair of calender roller in order to make the paper dust, or any others of those particles adhering to the paper web, ineffective. The quality of the material to be printed is improved by the compacting process, so that it is possible to use a material to be printed which is of lesser quality.

The method can be advantageously employed in connection with dry offset printing processes, wherein a cleaning effect of the printing plate by means of the dampening units is omitted. Moreover, in an advantageous manner, a regulating device for regulating the paper web tension is arranged between the pair of calender rollers and the first print unit. This regulating device is provided to be able to compensate for fluctuations in the tension of the paper web caused by the calendering process.

BRIEF DESCRIPTION OF THE DRAWINGS

A preferred embodiment of the present invention is represented in the drawing and will be described in greater detail in what follows. The sole drawing FIGURE shows a schematic representation of the course of the paper web as far as the first print unit, including the device in accordance with the present invention.

DESCRIPTION OF THE PREFERRED EMBODIMENT

A paper web 3 or similar print carrier is pulled off a paper web supply roll 2 which is located on a roll changer 1. The paper web 3 is conducted over a reversing roller 4 to a calender roller pair 8 consisting of first and second calender rollers 6, 7, respectively. Thereafter, the paper web 3 runs over a paper web tension regulating device 9 into a print unit 11 of a web-fed rotary printing press. The tension regulating device 9 utilizes a separate adjustable paper web tensioning roller 12 supported on a position adjustable arm 13. The paper web 3 passes around the tensioning roller 12 after it has left the calender roller pair 8, as shown in the sole drawing FIGURE. The print unit 11 is connected with ink units, not specifically represented, for example for a so-called waterless offset printing process, which is also known as dry offset printing.

"Waterless" printing formes such as, for example, planographic printing plates or planographic printing foils, are used in this print unit 11 so that no dampening units are required. However, because of the use of these "waterless" printing formes the "cleaning effect" of the dampening units is also missing.

Each calender roller 6, 7 can respectively have an elastic covering, for example made of rubber, or a hard covering, for example made of metal such as chromium.

In accordance with another preferred embodiment, it is possible for a one of the calender rollers 6 or 7 to have an elastic covering, and for the other one of the calender rollers 7 or 6 to have a hard covering.

The calender roller pair 8 can have a common drive mechanism, or each calender roller 6, 7 can be provided with an individual drive mechanism, for example an electric motor 14 or 15, respectively. It is also possible to drive only one calender roller 6 or 7 of the calender roller pair 8. Driving can be performed, for example, by means of a relative position-controlled electric motor such as electric motors 14 and 15, respectively.

The drive mechanism for the calender roller pair 8 is mechanically independent of other units, for example print units of the printing press. It is not connected by mechanical drive means to other units of the printing press.

Because of the arrangement of a calender roller pair 8 upstream of the print unit 11, paper dust or other particles adhering to the paper web 3 are introduced into the surface of the paper web 3, i.e. these particles are rolled into the paper web 3. The removal of these particles is omitted, and therefore additional device costs are also eliminated. The quality of the paper web is improved.

In place of paper webs 3, the arrangement of the calender roller pair 8 can also be used in connection with sheets of paper, for example in sheet-fed printing presses.

A paper web 3 of constantly even paper web tension is supplied to the print unit 11 by the arrangement of the paper web tension regulating device 9 between the calender roller pair 8 and the print unit 11.

While a preferred embodiment of the device for the treatment of a paper web in accordance with the present invention has been set forth fully and completely hereinabove, it will be apparent to one of skill in the art that various changes in, for example the overall number of print units used, the size of the print units, and their spacing, and the like, could be made without departing from the true spirit and scope of the present invention which is accordingly to be limited only by the following claims.

What is claimed is:

1. A device for treating a paper web prior to printing in a printing unit comprising:

at least a first print unit;

a calender roller pair positioned before, in a direction of travel of the paper web, said first print unit, said calender roller pair having at least first and second calender rollers;

a relative position-regulated electric motor for driving at least one of said at least first and second calender rollers of said calender roller pair; and a paper web tension regulating device positioned between said calender roller pair and said first print unit and including an adjustable paper web tensioning roller, the paper web passing around said adjustable paper web tensioning roller after passing through said calender roller pair.

2. The device of claim 1 wherein said first print unit is an offset printing unit operating with "waterless" planographic printing formes.

3. The device of claim 1 wherein each of said at least first and second calender rollers has an elastic covering.

4. The device of claim 1 wherein each of said at least first and second calender rollers has a hard covering.

5. The device of claim 1 wherein a first of said calender rollers has an elastic covering, and a second of said calender rollers has a hard covering.

6. The device of claim 1 wherein said calender roller pair has a common drive mechanism.

7. The device of claim 1 wherein each of said at least first and second calender rollers has a separate drive mechanism.

* * * * *